US009117323B2

(12) United States Patent
Brexel et al.

(10) Patent No.: US 9,117,323 B2
(45) Date of Patent: Aug. 25, 2015

(54) DEVICE FOR STACKING SECURITIES, IN PARTICULAR BANK NOTES

(75) Inventors: Dirk Brexel, Geseke (DE); Hans-Guenter Voss, Paderborn (DE)

(73) Assignee: Wincor Nixdorf International GmbH (DE)

( * ) Notice: Subject to any disclaimer, the term of this patent is extended or adjusted under 35 U.S.C. 154(b) by 1245 days.

(21) Appl. No.: 12/990,298

(22) PCT Filed: May 15, 2009

(86) PCT No.: PCT/EP2009/055932

§ 371 (c)(1),
(2), (4) Date: Oct. 29, 2010

(87) PCT Pub. No.: WO2009/138497

PCT Pub. Date: Nov. 19, 2009

(65) Prior Publication Data

US 2011/0052363 A1 Mar. 3, 2011

(30) Foreign Application Priority Data

May 16, 2008 (DE) ..... 10 2008 023 900

(51) Int. Cl.
*G07D 11/00* (2006.01)
*B65B 25/14* (2006.01)
(Continued)

(52) U.S. Cl.
CPC ..... *G07D 11/0006* (2013.01); *B65B 9/15* (2013.01); *B65B 25/14* (2013.01); *B65B 51/303* (2013.01);
(Continued)

(58) Field of Classification Search
CPC ..... B65H 2801/81; B65H 2701/1912; B65H 2405/311; B65H 2405/21; B65H 2405/20; B65H 2404/6911; B65H 2301/42142; B65H 2301/4214; B65H 31/26; B65H 31/22; B65H 31/06; B65B 9/15; B65B 25/14; G07D 11/0012; G07D 11/0006
USPC ..... 53/550, 551, 154, 541, 528, 542, 567, 53/570, 575–577, 284.7
See application file for complete search history.

(56) References Cited

U.S. PATENT DOCUMENTS 2,939,259 A * 6/1960 Heckler ..... 53/570
3,017,730 A * 1/1962 Rodish ..... 53/529
(Continued)

FOREIGN PATENT DOCUMENTS

DE 838874 C * 5/1952 ..... B65B 25/14
DE 4328136 A1 3/1995
(Continued)

OTHER PUBLICATIONS

English translation of the International Preliminary Report on Patentability for PCT/EP2009/055932 (Dec. 6, 2010), 10 pages.

*Primary Examiner* — Stephen F Gerrity
(74) *Attorney, Agent, or Firm* — Harness, Dickey & Pierce, P.L.C.

(57) ABSTRACT

An apparatus for stacking financial documents, in particular banknotes. The financial documents (BN) are stacked upright in a stacking area on a stacking surface, and the stacking operation is terminated when a predetermined stack length is reached. The stack formation takes place in a receiving bag (14) which is stationarily held by a holding frame (10) in the entry area of the financial documents (BN) and which forms a stock (15) around the circumference of the holding frame (10). With increasing stack length, receiving bag material is automatically taken from the stock (15) so that the length of the receiving bag (14) continuously adapts to the length of the value note stack (31). At the end of the stacking operation the receiving bag (14) is closed at its opening, e.g. by welding, and can subsequently be removed from the stacking area and can be used as a transport container or, respectively, a security bag.

20 Claims, 3 Drawing Sheets

(51) Int. Cl.

| | |
|---|---|
| ***B65B 9/15*** | (2006.01) |
| ***B65H 31/06*** | (2006.01) |
| ***B65B 51/30*** | (2006.01) |
| ***B65H 31/26*** | (2006.01) |
| ***E05G 1/00*** | (2006.01) |
| ***E05G 7/00*** | (2006.01) |
| *B65B 63/02* | (2006.01) |

(52) U.S. Cl.

CPC ..... *B65H 31/06* (2013.01); *B65H 31/26* (2013.01); *E05G 1/005* (2013.01); *E05G 7/001* (2013.01); *G07D 11/0012* (2013.01); *B65B 63/02* (2013.01); *B65H 2301/42142* (2013.01); *B65H 2404/6911* (2013.01); *B65H 2405/311* (2013.01); *B65H 2701/1912* (2013.01)

(56) References Cited

U.S. PATENT DOCUMENTS

| | | | | | |
|---|---|---|---|---|---|
| 3,049,312 | A | * | 8/1962 | Simjian | 242/527 |
| 3,377,772 | A | * | 4/1968 | Lyon et al. | 53/229 |
| 3,959,951 | A | * | 6/1976 | Paules | 53/157 |
| 4,374,463 | A | * | 2/1983 | Omura et al. | 53/54 |
| 4,493,179 | A | * | 1/1985 | Brak | 53/576 |
| 4,572,251 | A | * | 2/1986 | Drury | 141/1 |
| 4,993,210 | A | * | 2/1991 | Kollross | 53/567 |
| 5,148,655 | A | | 9/1992 | Salinas | |
| 5,313,766 | A | * | 5/1994 | Rimondi et al. | 53/451 |
| 5,425,565 | A | * | 6/1995 | Rogovein et al. | 294/119.1 |
| 5,483,784 | A | * | 1/1996 | Owensby et al. | 53/567 |
| 5,711,138 | A | * | 1/1998 | Yamamoto | 53/571 |
| 6,076,566 | A | * | 6/2000 | Lowe | 141/10 |
| 2002/0171194 | A1 | * | 11/2002 | Kuroda et al. | 271/177 |
| 2007/0145064 | A1 | | 6/2007 | Clauser et al. | |
| 2008/0073177 | A1 | * | 3/2008 | Hansson | 194/344 |
| 2008/0223915 | A1 | | 9/2008 | Williams et al. | |

FOREIGN PATENT DOCUMENTS

| | | | | | |
|---|---|---|---|---|---|
| EP | 373331 | A2 | * | 6/1990 | B65B 25/14 |
| EP | 0994445 | A2 | | 4/2000 | |
| EP | 1 755 089 | A | | 2/2007 | |
| FR | 2419219 | A1 | | 10/1979 | |
| JP | 52017992 | A | * | 2/1977 | 53/528 |
| JP | 52017994 | A | * | 2/1977 | 53/528 |
| WO | WO 0149566 | A1 | * | 7/2001 | B65B 25/14 |
| WO | WO-2006/018120 | A1 | | 2/2006 | |
| WO | WO-2006/041357 | A | | 4/2006 | |
| WO | WO-2006/072781 | A | | 7/2006 | |

* cited by examiner

DEVICE FOR STACKING SECURITIES, IN PARTICULAR BANK NOTES

CROSS-REFERENCE TO RELATED APPLICATIONS

This application is a National Stage of International Application No. PCT/EP2009/055932, filed May 15, 2009. This application claims the benefit and priority of German application 10 2008 023 900.3 filed May 16, 2008. The entire disclosures of the above applications are incorporated herein by reference.

BACKGROUND

This section provides background information related to the present disclosure which is not necessarily prior art.

1. Technical Field

The invention relates to an apparatus for stacking notes of value or financial documents, in particular banknotes, in a transport container into which the financial documents are successively inserted through a front entry area upright on a stacking surface of a stacking area against a rear pressure device which, with increasing number of inserted financial documents, is adjustable such that a value note stack of a predetermined length is formed between the rear pressure device and a front pressure device.

2. Discussion

An apparatus of this type is used, for example, in value note machines which can take in and/or dispense financial documents. Financial documents or value notes are, for example, banknotes, coupons or papers of value. Mostly, the financial documents, in particular banknotes, are kept ready in a stacked manner in cassettes which can be inserted into an output machine. Here, the cassettes serve as transport containers which, outside of the machine, are closed by means of security devices and can only be opened by authorized people. When the value note machine has an input function, then input financial documents are sorted in the machine according to value and/or format and are then supplied to cassettes in which they are stacked upright on a stacking surface. When a cassette is filled with stacked financial documents, then it can be removed from the machine and then likewise serves as a transport container.

Usually, the financial documents are inserted into their transport container such that, when being supplied into its entry area, they stand upright in the container cross-section and are pushed along the bottom of the transport container serving as a stacking surface by means of a front pressure device in the form of at least one vane wheel having rigid and/or flexible vanes against the rear pressure device so as to rest against this rear pressure device. When financial documents are progressively supplied, a value note stack consisting of upright value notes is formed, the growth of which is made possible by an appropriately adjusted movement of the rear pressure device in stacking direction.

It is already known to store financial documents not only in cassettes which are closed on all sides and serve as transport containers but to also use security bags of film material for this purpose. This becomes, for example, necessary when relatively complex cassettes are dispensed with or the transport of the financial documents is otherwise secured and thus special cassettes are not necessary.

A security bag for financial documents is, for example, known from the document WO 2006/018120 A1. It serves to transport banknotes and has an access opening and a closing device for closing the access opening. The security bag is comprised of several portions, and the access opening and the closing device are formed in the film material. The automatic filling of such a security bag in a value note input machine of the afore-described type as well as a transport cassette are not described.

In order to make it possible that a machine for the automatic processing of financial documents, in particular banknotes, can also be used in connection with security bags, according to document US 2007/0145064 A1 a security bag can be provided in a closable and transportable value note cassette. This security bag is provided with closing and stacking elements, the construction of which is adapted to the cassette construction. It can only be removed from the cassette, when a sliding closure guided in the cassette has previously been manually actuated. Such a solution is technically complex and does not allow the use of a security bag independent of a cassette.

SUMMARY OF THE INVENTION

It is an object of the invention to specify an apparatus for stacking financial documents in a transport container, which apparatus can be inserted into a value note machine and allows the use of a security bag which, after automatic filling, can be easily removed from the machine.

The invention solves this object for an apparatus of the type mentioned at the beginning in that in the entry area a stationary holding frame for a receiving bag is arranged, the opening cross-section of which at least corresponds to the format of the financial documents and at the circumference of which a stock of receiving bag material is present such that the stack of value notes is formed within the receiving bag and the length of the receiving bag is adapted, using the stock of receiving bag material, to the growing stack length by the adjustment movement of the rear pressure device.

In the invention, the principle of stack formation of value notes standing upright on a stacking surface is used, according to which principle many known value note processing machines work. However, in the invention it becomes possible by means of a very simple procedure to use this type of stack formation directly in a bag-shaped transport container which, after reaching a predetermined stack length, can be closed very easily but securely by means of welding or adhesive bonding in a manner known per se. Moreover, given this principle, it is possible to accommodate different stack lengths in the receiving bag since a mode of operation can be realized which allows for a termination of the stack formation at an arbitrary stack length that is only limited by the length of the stacking surface.

An apparatus according to the invention can fill a receiving bag as a substitute for a transport cassette with value notes in a value note input machine, one filled receiving bag each being removed from the machine. It is, however, likewise possible to create the value note stack in a receiving bag that is already contained in a transport cassette. Thus, the invention allows the optional use of the receiving bag without transport cassette or indeed within a transport cassette from which it can be removed at an arbitrary point in time and, as the case may be, can be transported further. Thus, the invention allows using automatically operating value note machines optionally in connection with receiving bags or with value note cassettes in which a receiving bag can be contained.

The apparatus can be adapted in a particularly favorable manner to common automatically operating machines for processing financial documents. Such automatically operating machines for processing banknotes are also referred to as cash machines.

BRIEF DESCRIPTION OF THE DRAWINGS

The invention is now explained in more detail with reference to the drawings.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

In the following description of an embodiment of the invention, its use in a machine for depositing banknotes is assumed. The invention, however, can likewise be used in the same manner also for financial documents of a different type.

Figure 1:
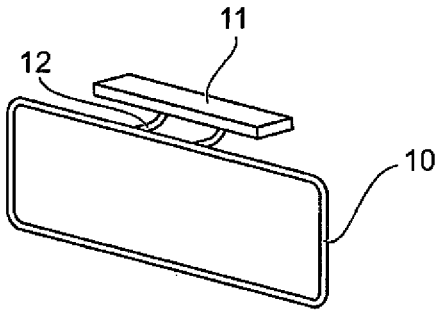
FIG. 1 shows a holding frame for a receiving bag.

FIG. 1 shows a holding frame 10 which is approximately orthogonally connected to a mounting plate 11 via two braces 12. The holding frame 10 can, for example, be made of a round wire material and has a rectangular shape in the illustrated embodiment. The holding frame 10 serves to keep the opening of a receiving bag not illustrated in FIG. 1 open, the receiving bag material being placed around the holding frame 10 towards the outside, can be fixed thereto and can form a stock around the circumference of the holding frame 10.

Figure 2:
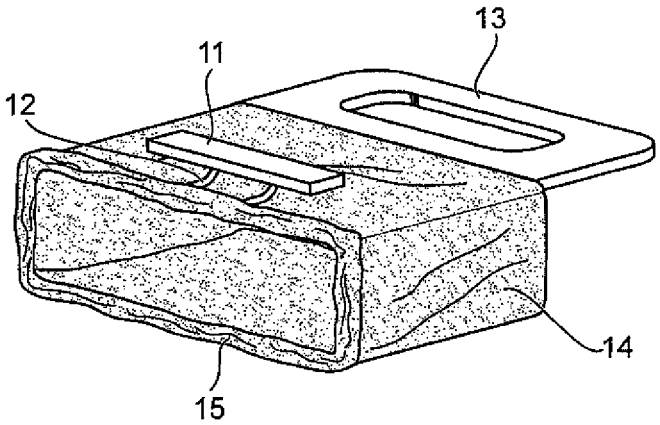
FIG. 2 shows a receiving bag attached to the holding frame according to FIG. 1.

This is illustrated in FIG. 2 which shows the receiving bag 14 that forms a stock 15 around the circumference of the holding frame 10 not visible here. The receiving bag material can be a film material or also a tissue material, e.g. made of plastic fibers, and is wound up or gathered around the circumference of the holding frame 10 so as to form a stock. At the rear end of the receiving bag 14, there is a handle 13 with which the receiving bag 14 can be handled, e.g. transported. The length of the receiving bag 14 can be increased in that, while the holding frame 10 is stationary, the receiving bag bottom is pulled and the stock 15 at the holding frame 10 is reduced.

The front opening of the receiving bag 14 has a format which is predetermined by the dimensions of the holding frame 10 (FIG. 1). The opening is dimensioned such that banknotes can be stacked upright in the receiving bag 14, as this is already known for respective receiving cassettes. The use of the receiving bag 14 for receiving banknotes allows its use as a transport container which, when securely closed, can also serve as a security bag. The filling of a receiving bag 14 of this type with banknotes in a cash deposit machine is now described with reference to FIGS. 3*a* to 3*d*.

Figure 3A:
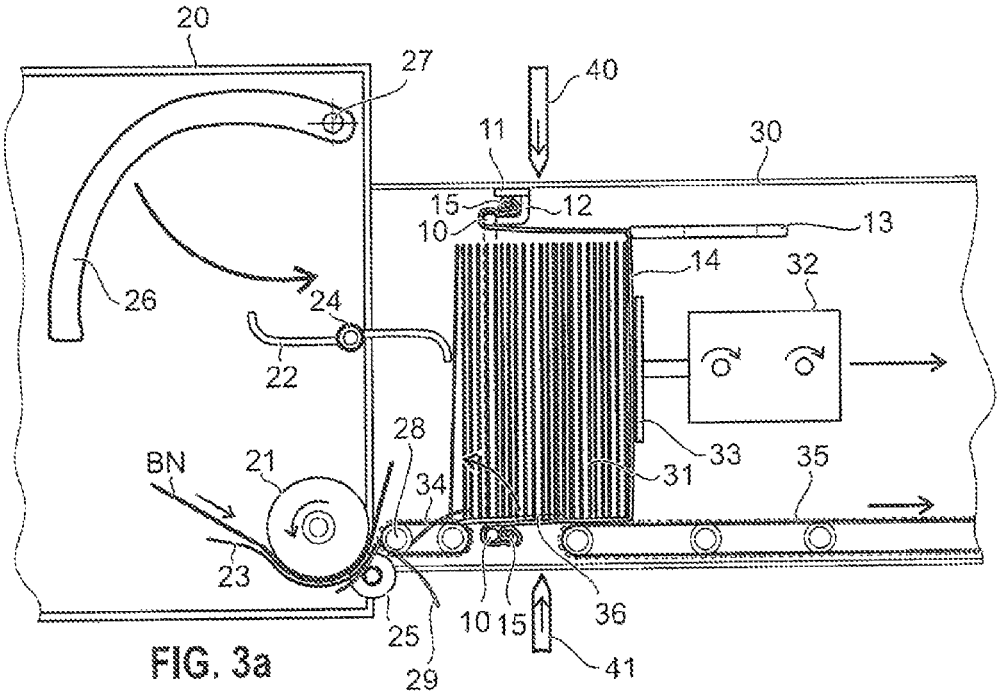
FIG. 3*a* is a schematic partial illustration, in a side view, of an apparatus for stacking financial documents in a first operating position.

In FIG. 3*a*, the allocation of a cash deposit machine 20 to a cash receiving cassette 30 in a first operating state is schematically and partially illustrated. The invention could likewise be used in a cash deposit/cash dispensing machine, and here the cash receiving cassette 30 shall only be understood as an example of a stacking area for banknotes, wherein its use as a transport container to be removed from a machine is not inevitably necessary for the invention.

In the cash deposit machine 20, a feed roller 21 is schematically illustrated which can extend over the entire width of the machine 20 and is mostly comprised of several individual rollers on a common or several individual shafts. It is rotated counterclockwise in the direction of the arrow as illustrated to transport a banknote BN input into the machine 20 in a non-illustrated manner along a guide surface 23 into a feeding area located in front of a banknote stack 31 already contained in a stacking area of the cash receiving cassette 30. The banknotes of the banknote stack 31 are stacked upright, and the stack formation is made possible, on the one hand, by means of a vane wheel 22 having rigid vanes which press the banknotes of the banknote stack 31 from the feeding area into the stacking area, and, on the other hand, by means of a rear pressure carriage 32 which is connected to a pressure plate 33 against which the banknote stack 31 rests.

When a banknote BN is supplied between the feed roller 21 and the guiding surface 23 to the feeding area in front of the banknote stack 31 already contained in the stacking area, then it reaches into the area of the vanes of the vane wheel 22 which is rotated counterclockwise on a vane wheel shaft 24. In the operating position shown in FIG. 1, the banknotes of the banknote stack 31 already contained in the stacking area are pushed out of the feeding area by a first vane of the vane wheel 22. When the banknote BN is fed into the feeding area, this first vane is moved in front of the front edge of the banknote BN by a corresponding rotation of the vane wheel 22 so that the front edge of the banknote BN does not contact the vane during feeding into the feeding area. Hereby it is achieved that the feeding movement of the banknote BN into the feeding area is not impeded by the vane. The two-vaned vane wheel 22 is rotated counterclockwise by 180° during feeding of the banknote BN so that during this rotation the second vane presses the banknote BN fed into the feeding area against the front side of the already present banknote stack 31. If the banknote BN is the first banknote of the banknote stack 31, the second vane of the vane wheel 22 presses the banknote BN fed into the feeding area against the pressure plate 33 of the pressure carriage 32. The vane wheel 22 can thus be considered as the front pressure device.

The feed roller 21 is opposite to a further feed roller 25, and the supplied banknote BN is positively conveyed further between these two feed rollers 21 and 25 when it leaves the transport portion formed by the guiding surface 23. This movement is supported by a further vane wheel 28 which rotates clockwise and the flexible vanes 29 of which move the respective banknote BN transported into the feeding area in the lower area of the banknote towards the banknote stack 31 and thus keep it in its upright stacking position. Over the width of the machine 20, several such vane wheels 28 can be provided. In the present embodiment, the supplied banknotes BN are stacked upright on their long side in the stacking area of the cash receiving cassette.

The rear pressure carriage 32 can be moved to the right in the direction of the arrow illustrated to allow growth of the banknote stack 31. For this, it can be guided along the two inside surfaces of the cash receiving cassette 30 and can be coupled to a drive, not illustrated in detail here, which can be controlled in an appropriate manner.

During formation of the stack, the banknote stack 31 rests on a stacking surface which is formed by the upper courses of two continuous transport bands 34 and 35 as well as a pivotable connecting plate 36 arranged therebetween. The two continuous transport bands 34 and 35 are driven in a non-illustrated manner such that its upper courses are moved from the left to the right with respect to the illustration in FIG. 3*a* in coordination with the movement of the rear pressure carriage 32 dependent on the growth of the length of the banknote stack 31. The continuous transport band 34 can consist of several transport belts distributed over the width of the machine 20, between which belts several vane wheels 28 are arranged.

In the entry area of the cash receiving cassette 30, the holding frame 10 shown in FIG. 1 is installed, the mounting plate 11 being mounted on the upper cover of the cash receiving cassette 30. As shown in FIG. 2, the holding frame 10 holds a receiving bag 14, and due to the size of the holding frame 10 which corresponds to the largest provided banknote format it is made possible to stack the banknotes directly in the receiving bag 14. The receiving bag rests with its underside on the upper courses of the continuous transport bands 34 and 35 as well as on the connecting plate 36 and receives the banknote stack 31. When the length of the banknote stack 31 increases with a progressive movement of the rear pressure carriage 32 towards the right, the receiving bag material is progressively taken from the stock 15 and the length of the receiving bag 14 receiving the banknote stack 31 is increased. In order to support this operation, the pressure plate 33 can be mechanically coupleable or connected to the receiving bag bottom so that, when the rear pressure carriage 32 moves from the left to the right, the receiving bag 14 is likewise pulled in this direction. The bottom of the receiving bag 14 can also be separately provided with a reinforcing area, e.g. a rectangular plate, the format of which at least corresponds to the format of the banknotes BN. As a result thereof, the pressure plate 33 can be more easily connected to the receiving bag bottom.

In FIG. 3*a*, an upper and a lower welding electrode 40 and 41 are schematically illustrated, which, in manner still to be described, serve to close the receiving bag 14 after forming a banknote stack 31 of a predetermined length. Further welding electrodes can likewise be provided, which are arranged, for example, orthogonally to the illustrated welding electrodes 40 and 41.

Figure 3B:
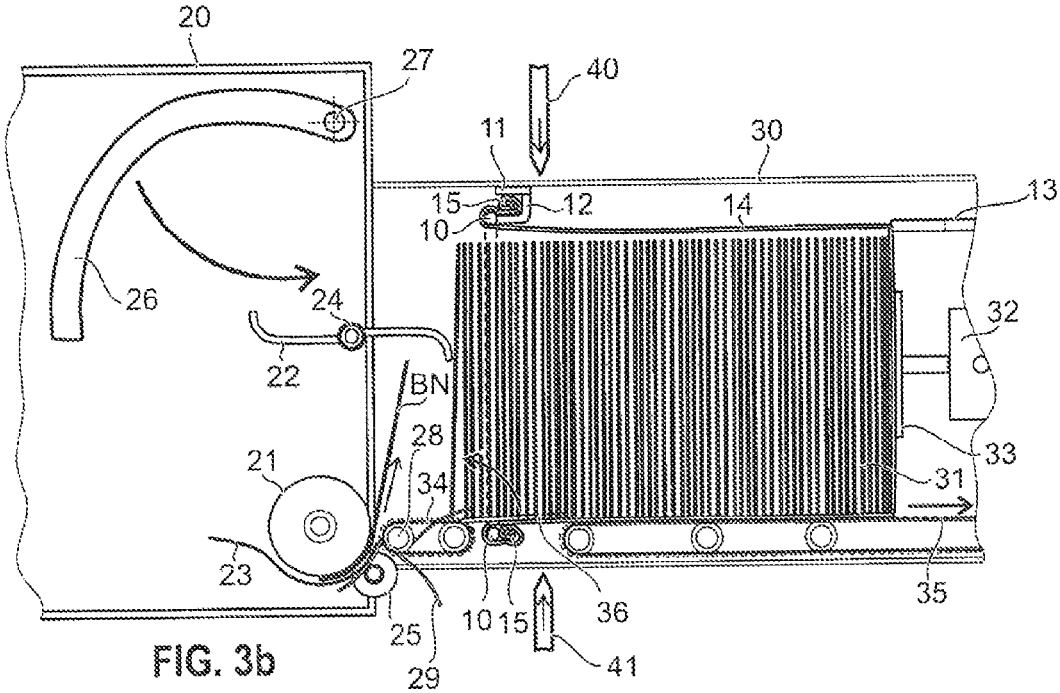
FIG. 3*b* shows the apparatus illustrated in FIG. 3*a* in a second operating position.

FIG. 3*b* shows a second operating state of the apparatus described above in connection with FIG. 3*a*, wherein the length of the banknote stack 31 has increased and the rear pressure carriage 32 has been correspondingly moved further to the right. It can be seen that the banknote stack 31 is held between the vane wheel 22 and the pressure plate 33 and increases its length when banknotes BN are progressively pushed in. During stacking of the banknotes BN, the banknote stack 31 is moved to the right until a predetermined length is reached. In doing so, the receiving bag 14 is extended correspondingly, the receiving bag material being taken from the stock 15.

Figure 3C:
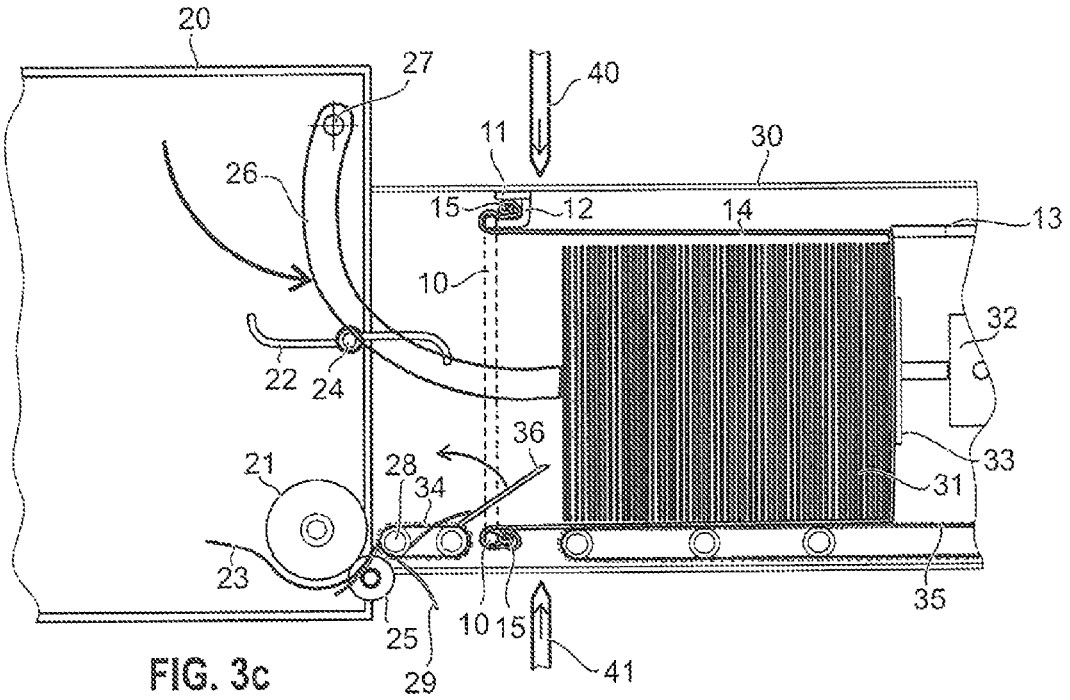
FIG. 3*c* shows the apparatus illustrated in FIGS. 3*a* and 3*b* in a third operating position.

FIG. 3*c* shows a third operating state of the above described apparatus, in which a curved pressure lever 26, which is pivotally mounted in the machine 20 at 27, has been pivoted counterclockwise and has pressed the banknote stack 31 in the direction towards the pressure plate 33 to reduce its length and to allow the future closing of the receiving bag 14 in a fixedly packed manner. The length of the banknote stack 31 is reduced so far compared to the illustration in FIG. 3*b* that the connecting plate 36 can be pivoted counterclockwise to create a space in the entry area of the receiving bag 14 to the right side of the holding frame 10, in which space the lower welding electrode 41 can be moved into the entry area via an opening of the cash receiving cassette 30, which opening is not illustrated in more detail here, to weld the receiving bag 14 together with the upper welding electrode 40 which has likewise been moved into the entry area for this. Alternatively or additionally, the banknote stack 31 can be moved further into the receiving bag 14 when the pressure lever 26 is pivoted and when the pressure plate 33 is simultaneously moved to the right. Thereafter, the receiving bag 14 can be closed as described.

Figure 3D:
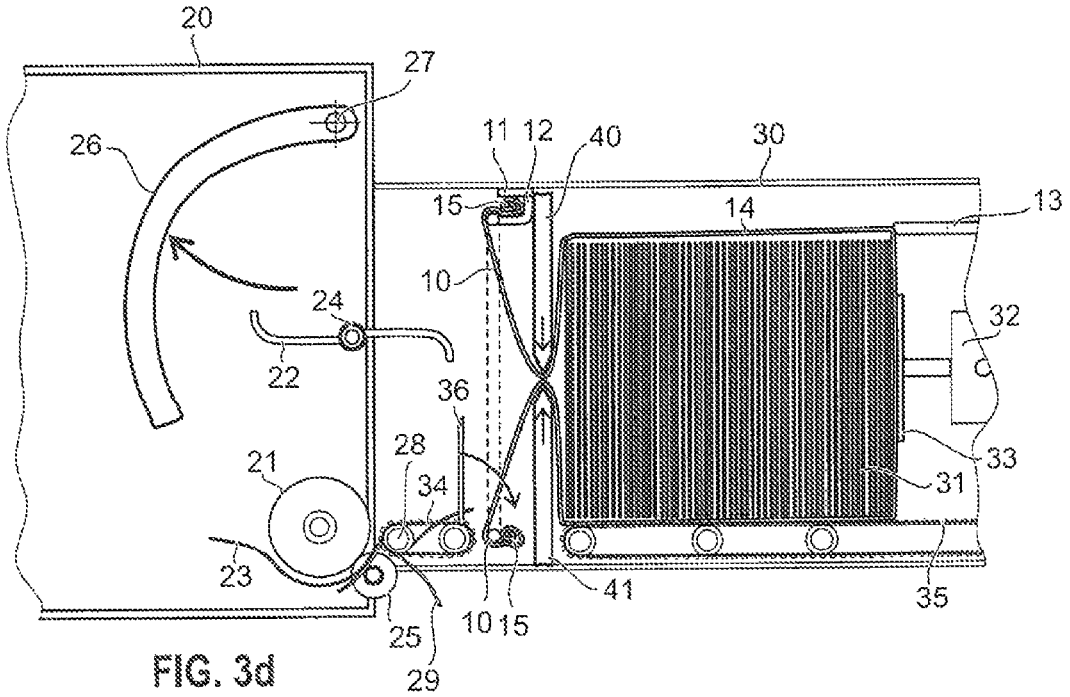
FIG. 3*d* shows the apparatus illustrated in FIGS. 3*a* to 3*c* in a fourth operating position.

This state is illustrated in FIG. 3*d*, here the connecting plate 36 is arranged in an approximately vertical position, and the welding electrodes 40 and 41 are moved into the cash receiving cassette 30, the receiving bag material, when re-supplied from the stock 15, being brought together approximately in the middle of the entry area and being welded to close the receiving bag 14. Then it can be separated from the stock 15 and, as the case may be, be removed from the cash receiving cassette on the handle 13. Subsequently, the connecting plate 36 can be clockwise swiveled back into its horizontal position.

The functions taking place in an apparatus according to the invention have been described above according to their principle. These functions can be automatically controlled, as this is known for known cash dispensing and/or deposit machines which work with cash receiving cassettes, however without receiving bags of the type described. Instead of the principle described, in which a receiving bag is contained in a cash receiving cassette, an apparatus according to the invention can also fill a receiving bag which is not contained in a cash receiving cassette. Therefore, the invention can be universally used, on the one hand, as a component part of a machine and, on the other hand, as an independent apparatus. In this connection, it is possible to fill the receiving bags 14 with different stack lengths and to close them also by other types of closures, in particular by clamping or adhesive bonding the tube-shaped end of the receiving bag 14.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. An assembly for stacking financial documents in a receiving bag of a transport container including a front entry area, a stacking area, a rear pressure device, and an apparatus for stacking the financial documents in the receiving bag, wherein the financial documents can be stacked upright on a stacking surface of the stacking area against the rear pressure device, and wherein the rear pressure device, with increasing number of inserted financial documents, can be adjusted such that a stack of financial documents of a predetermined length is formed between the rear pressure device and a front pressure device, comprising wherein in the entry area a stationary holding frame for the receiving bag is arranged, an opening cross-section of which corresponds at least to the size of the financial documents and at the circumference of which a stock of receiving bag material is provided such that the stack of financial documents is formed within the receiving bag and the length of the receiving bag is adapted, using the stock of the receiving bag material, to the growing stack length by adjustment movement of the rear pressure device.

2. The assembly according to claim 1, wherein the receiving bag material is a film material or a tissue material which is wound up or gathered around the circumference of the holding frame.

3. The assembly according to claim 1, wherein the bottom of the receiving bag is provided with a reinforcing area, the size of which corresponds at least to the size of the financial documents.

4. The assembly according to claim 3, comprising a rectangular plate reinforcing the receiving bag bottom.

5. The assembly according to claim 1, wherein the rear pressure device can be mechanically coupled to the receiving bag bottom.

6. The assembly according to claim 1, further comprising a closing device for the receiving bag, which is arranged behind the holding frame in the entry area.

7. The assembly according to claim 6, wherein the closing device includes several welding electrodes which can be moved towards one another from a position outside the circumference of the holding frame to weld the receiving bag material.

8. An assembly for stacking financial documents comprising:

a cassette including:

a receiving bag mounted within the cassette with a mounting plate, the receiving bag including a frame defining an opening configured to receive financial documents therethrough, and a stock of receiving bag material mounted to the frame; and a movable rear pressure device against which financial documents inserted within the receiving bag are stacked, the rear pressure device configured to expand the stock as financial documents are loaded; and a machine configured to couple with the cassette and load financial documents into the cassette.

9. The assembly of claim 8, wherein the mounting plate is coupled to the frame of the receiving bag with braces.

10. The assembly of claim 8, further comprising a front pressure device, the front pressure device and the rear pressure device are configured to compress financial documents arranged therebetween.

11. The assembly of claim 10, wherein the front pressure device is mounted to the machine.

12. The assembly of claim 11, wherein the front pressure device is a vane wheel.

13. The assembly of claim 8, further comprising a lever mounted to the machine and configured to extend into the cassette and the receiving bag to compress a stack of financial documents within the receiving bag.

14. The assembly of claim 8, further comprising a pair of welding electrodes configured to seal the receiving bag closed.

15. The assembly of claim 8, wherein the receiving bag further comprises a handle.

16. The assembly of claim 8, wherein the receiving bag includes a reinforcing plate to reinforce a bottom of the receiving bag.

17. The assembly of claim 8, wherein the rear pressure device is coupled to a bottom of the receiving bag.

18. An assembly for stacking financial documents comprising:

a cassette including:

a receiving bag mounted within the cassette with a mounting plate, the receiving bag including a frame defining an opening configured to receive financial documents therethrough, and a stock of receiving bag material mounted to the frame; and a movable rear pressure device against which financial documents inserted within the receiving bag are stacked, the rear pressure device is coupled to a bottom of the receiving bag and configured to expand the stock as financial documents are loaded;

a machine configured to couple with the cassette and load financial documents into the cassette, the machine including a front pressure device configured to compress financial documents against the rear pressure device; and a closing device configured to close the receiving bag after financial documents have been loaded therein.

19. The assembly of claim 18, wherein the mounting plate is coupled to the frame of the receiving bag with braces.

20. The assembly of claim 18, wherein the closing device includes a pair of welding electrodes configured to move together from a position outside a circumference of the frame.

* * * * *